US010752273B2

(12) United States Patent
Clanney

(10) Patent No.: US 10,752,273 B2
(45) Date of Patent: Aug. 25, 2020

(54) TRAIN DIRECTION AND SPEED DETERMINATIONS USING LASER MEASUREMENTS

(71) Applicant: SIEMENS MOBILITY, INC., New York, NY (US)

(72) Inventor: Nathan Clanney, Corona, CA (US)

(73) Assignee: Siemens Mobility, Inc., New York, NY (US)

( * ) Notice: Subject to any disclaimer, the term of this patent is extended or adjusted under 35 U.S.C. 154(b) by 345 days.

(21) Appl. No.: 15/651,748

(22) Filed: Jul. 17, 2017

(65) Prior Publication Data

US 2019/0016358 A1 Jan. 17, 2019

(51) Int. Cl.

| | |
|---|---|
| ***B61L 29/30*** | (2006.01) |
| ***B61L 29/22*** | (2006.01) |
| ***B61L 25/02*** | (2006.01) |
| ***B61L 29/32*** | (2006.01) |

(52) U.S. Cl.

CPC ..... *B61L 29/228* (2013.01); *B61L 25/021* (2013.01); *B61L 25/023* (2013.01); *B61L 29/30* (2013.01); *B61L 29/32* (2013.01)

(58) Field of Classification Search

CPC ..... B61L 1/166; B61L 13/005; B61L 25/021; B61L 25/023; B61L 29/228

See application file for complete search history.

(56) References Cited

U.S. PATENT DOCUMENTS

| | | | | | |
|---|---|---|---|---|---|
| 2,061,785 | A * | 11/1936 | Vanhorn | B61L 29/288 | 246/130 |
| 2,063,298 | A * | 12/1936 | Crago | B61L 13/005 | 246/29 R |
| 2,089,835 | A * | 8/1937 | Logan, Jr. | B61L 13/005 | 246/29 R |
| 2,494,435 | A * | 1/1950 | Freeman | B61L 13/005 | 246/114 R |
| 2,549,146 | A * | 4/1951 | Van Horn | B61L 13/005 | 246/160 |
| 3,004,149 | A * | 10/1961 | Staples | B61L 13/005 | 246/29 R |
| 3,109,157 | A * | 10/1963 | Bolton | G08G 1/065 | 340/935 |
| 3,725,699 | A * | 4/1973 | Pascoe | B61L 13/005 | 246/114 R |
| 3,941,338 | A * | 3/1976 | Knudsen | B61L 1/16 | 246/77 |
| 4,200,856 | A * | 4/1980 | Gilcher | B61L 1/025 | 246/249 |
| 5,314,037 | A * | 5/1994 | Shaw | B60K 23/08 | 180/169 |
| 5,764,162 | A * | 6/1998 | Ehrlich | B61L 1/165 | 246/122 R |
| 6,340,139 | B1 * | 1/2002 | Hilleary | B61L 29/08 | 246/125 |
| 6,641,091 | B1 * | 11/2003 | Hilleary | B61L 29/08 | 246/111 |
| 8,752,797 | B2 * | 6/2014 | Carlson | B61L 1/164 | 246/122 R |

(Continued)

*Primary Examiner* — Zachary L Kuhfuss

(57) ABSTRACT

System and methods for determining train direction and speed using laser measurements. The speed and direction determinations can be used to monitor, diagnose, and/or report the operational performance of a crossing warning system.

22 Claims, 8 Drawing Sheets

(56) References Cited

U.S. PATENT DOCUMENTS

| | | | | |
|---|---|---|---|---|
| 2010/0107925 | A1* | 5/2010 | Bounds | E01B 27/02 105/311.1 |
| 2011/0315852 | A1* | 12/2011 | Borlez | B61L 29/02 250/206 |
| 2016/0189552 | A1* | 6/2016 | Hilleary | B61L 29/28 246/125 |
| 2016/0264163 | A1* | 9/2016 | Schmidt | G06F 16/29 |
| 2019/0016358 | A1* | 1/2019 | Clanney | B61L 29/228 |

* cited by examiner

TRAIN DIRECTION AND SPEED DETERMINATIONS USING LASER MEASUREMENTS

BACKGROUND

1. Field

Embodiments of the invention relate to railroad track monitoring and, more particularly, to train direction and speed determinations using laser measurements.

2. Description of the Related Art

A grade crossing predictor (often referred to as a crossing predictor in the U.S., or a level crossing predictor in the U.K.) is an electronic device that is connected to the rails of a railroad track and is configured to detect the presence of an approaching train and determine its speed and distance from a crossing (i.e., a location at which the tracks cross a road, sidewalk or other surface used by moving objects). The grade crossing predictor will use this information to generate a constant warning time signal for controlling a crossing warning device. A crossing warning device is a device that warns of the approach of a train at a crossing, examples of which include crossing gate arms (e.g., the familiar black and white striped wooden arms often found at highway grade crossings to warn motorists of an approaching train), crossing lights (such as the red flashing lights often found at highway grade crossings in conjunction with the crossing gate arms discussed above), and/or crossing bells or other audio alarm devices. Grade crossing predictors are often (but not always) configured to activate the crossing warning device at a fixed time (e.g., 30 seconds) prior to an approaching train arriving at a crossing.

As is known in the art, there is a need to confirm that grade crossing predictors are operating properly to ensure public safety at railroad crossings. As such, the operation of grade crossing predictors are inspected about once a year per federal regulations. A grade crossing predictor is required to be tested in real-time and with approaching trains from both sides of the crossing (e.g., north and south approaching trains, east and west approaching trains, etc.). Typically, an inspector observes approaching trains and uses a stop watch to determine if the grade crossing predictor is activating the crossing warning devices at proper times for both sides of the crossing.

It is desirable to perform monitoring and diagnostic testing of grade crossing predictors independent of the mandated inspections. It is also desirable for the monitoring and diagnostic testing to be performed in an automated manner at e.g., periodic or other intervals desirable by the railroad company or maintenance personnel. In many currently existing crossing installations, however, there is no automated way to determine a train's direction to ensure that the grade crossing predictor is tested with approaching trains from both sides of the crossing. The train's speed may be determined by e.g., the grade crossing predictor. Absent other equipment or systems, however, the grade crossing predictor can only determine if the train is approaching the crossing or moving away from the crossing. Accordingly, an automated technique for determining train direction and speed at e.g., a crossing is desired.

SUMMARY

Embodiments disclosed herein provide systems and methods for determining train direction and speed using laser measurements. The speed and direction determinations can be used to monitor, diagnose, and/or report the operational performance of a crossing warning system.

In one embodiment, a system is provided. The system comprises at least one laser device adapted to provide a laser beam towards a location on a railroad track and being adapted to provide one or more outputs when the laser beam is reflected back by a train traversing the track and a control unit adapted to input the one or more outputs from the at least one laser device, said control unit being adapted to determine a direction and speed of the train based on the one or more outputs from the at least one laser device and timing information associated with the one or more outputs.

In another embodiment, a method is provided. The method comprises inputting one or more outputs from at least one laser device while a train is traversing a railroad track and determining a direction and speed of the train based on the one or more outputs from the at least one laser device and timing information associated with the one or more outputs.

Further areas of applicability of the present disclosure will become apparent from the detailed description, drawings and claims provided hereinafter. It should be understood that the detailed description, including disclosed embodiments and drawings, are merely exemplary in nature intended for purposes of illustration only and are not intended to limit the scope of the invention, its application or use. Thus, variations that do not depart from the gist of the invention are intended to be within the scope of the invention.

BRIEF DESCRIPTION OF THE DRAWINGS

Like reference symbols in the various drawings indicate like elements.

DETAILED DESCRIPTION

The components and materials described hereinafter as making up the various embodiments are intended to be illustrative and not restrictive. Many suitable components and materials that would perform the same or a similar function as the materials described herein are intended to be embraced within the scope of embodiments of the present invention. As discussed in more detail below, the disclosed embodiments provide systems and methods for determining train direction and speed using laser measurements. The speed and direction determinations can be used to monitor, diagnose, and/or report the operational performance of crossing warning system (e.g., a grade crossing predictor).

Figure 1:
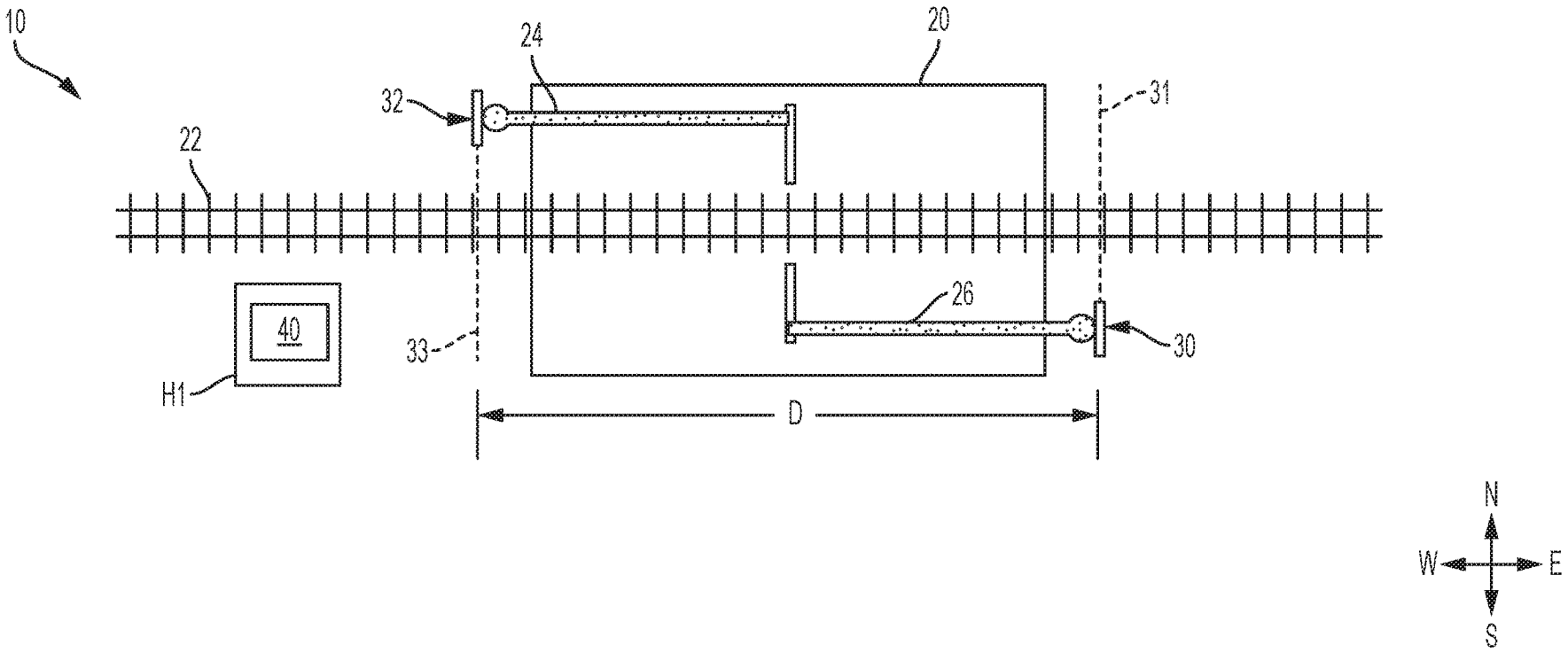
FIG. 1 illustrates an overhead and block view of an example system for determining train direction and speed and using the determination to monitor, diagnose and/or report the status of a crossing warning system constructed in accordance with an embodiment disclosed herein.

FIG. 1 illustrates an overhead and block view of an example system 10 for determining train direction and speed and using the determination to monitor, diagnose and/or report the status of a crossing warning system constructed in accordance with an embodiment disclosed herein. In the illustrated embodiment, the system 10 is provided at a location in which a road 20 crosses a railroad track 22 (i.e., a railroad crossing). The illustrated track 22 is laid out in an east-to-west/west-to-east direction. Thus, in the illustrated embodiment, there are two directions for a train to pass through the crossing (i.e., heading east-to-west or heading west-to-east). It should be appreciated, however, that the track 22 could be laid out in other directions as is known in the art.

Two warning devices implemented as first and second railroad crossing gates 24, 26 are also located at the crossing of the road 20 and railroad track 22. In the illustrated example, the arms of the crossing gates 24, 26 are lowered (e.g., in a horizontal position) blocking both sides of the road 20 from oncoming vehicular traffic as is known in the art. Although not shown in FIG. 1, the first and second railroad crossing gates 24, 26 are controlled by a crossing warning system that is connected to the track such as e.g., a grade crossing predictor as is known in the art. The grade crossing predictor (not shown) may be included in an equipment housing H1 such as e.g., a wayside shelter.

To implement the laser-based train direction and speed monitoring, determinations and reporting disclosed herein, the illustrated system 10 includes a first laser device 30 located on a first side of the crossing of the road 20 and railroad track 22 and a second laser device 32 located on a second side of the crossing. In the illustrated embodiment, the first and second laser devices 30, 32 are positioned at a predetermined distance D apart from each other. The first laser device 30 outputs a first laser beam 31 and the second laser device 32 outputs a second laser beam 33 that are also the predetermined distance D apart from each other.

The laser devices 30, 32 are in communication with a control unit 40, which may be a processor, microprocessor, computer, computer workstation, laptop computer or a similar device that may also be included in the housing H1. The laser devices 30, 32 may be in wired or wireless communication with the control unit 40. It should be appreciated that any form of wired communications and connections can be used such as e.g., wired serial port connections, parallel port connections, Ethernet connections, wired Internet Protocol or network connections, etc. Moreover, it should be appreciated that any form of wireless communications can be used such as e.g., Wi-FI, cellular, Bluetooth, Near-field Communications, Zigbee, Satellite, etc.

In one embodiment, the first laser device 30 will generate a signal when the laser beam 31 is reflected back by e.g., a train on the railroad track 22. This signal can be considered to be a train detection signal. The first laser device 30 will output the train detection signal to the control unit 40 via the wired or wireless communications discussed above. In one embodiment, the train detection signal and information identifying the first laser device 30 as the device that detected the train is transmitted to the control unit 40. The information identifying the first laser device 30 can be a device identifier programmed into the device 30, a serial number of the device 30, a text-based or character identifier, a combined numerical and text-based identifier, or any type of identifier that can be associated with device 30.

Similarly, the second laser device 32 will generate a signal when the laser beam 33 is reflected back by e.g., a train on the railroad track 22. This signal can be considered to be a train detection signal. The second laser device 32 will output the train detection signal to the control unit 40 via the wired or wireless communications discussed above. In one embodiment, the train detection signal and information identifying the second laser device 32 as the device that detected the train is transmitted to the control unit 40. As noted above, the information identifying the second laser device 32 can be a device identifier programmed into the device 32, a serial number of the device 32, a text-based or character identifier, a combined numerical and text-based identifier, or any type of identifier that can be associated with device 32.

The control unit 40 is capable of inputting the signals output from the laser devices 30, 32 and will be able to determine which laser device 30, 32 sent the signal. The control unit 40 will use the timing of the signals to determine train direction and speed (explained below in more detail with respect to FIG. 3). For example, the control unit 40 can time stamp the receipt of the signals to determine when they arrived. As is discussed below in more detail, the control unit 40 will use the time stamps of the signals, the data identifying which device 30, 32 transmitted which signal, and the distance D between the laser devices 30, 32 to determine the direction and speed of a train passing through the crossing of the road 20 and railroad track 22.

Figure 2A:
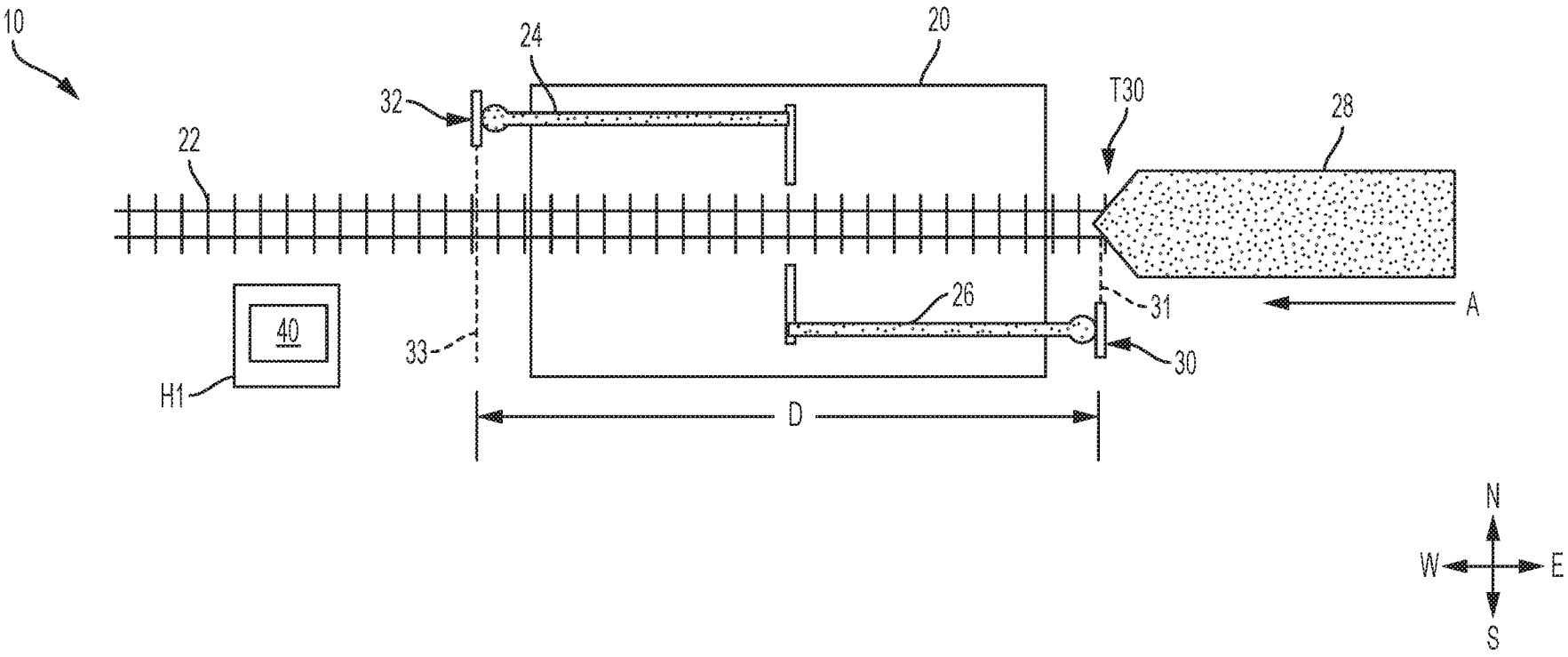
FIGS. 2A and 2B illustrate the system of FIG. 1 in use.
Figure 2B:
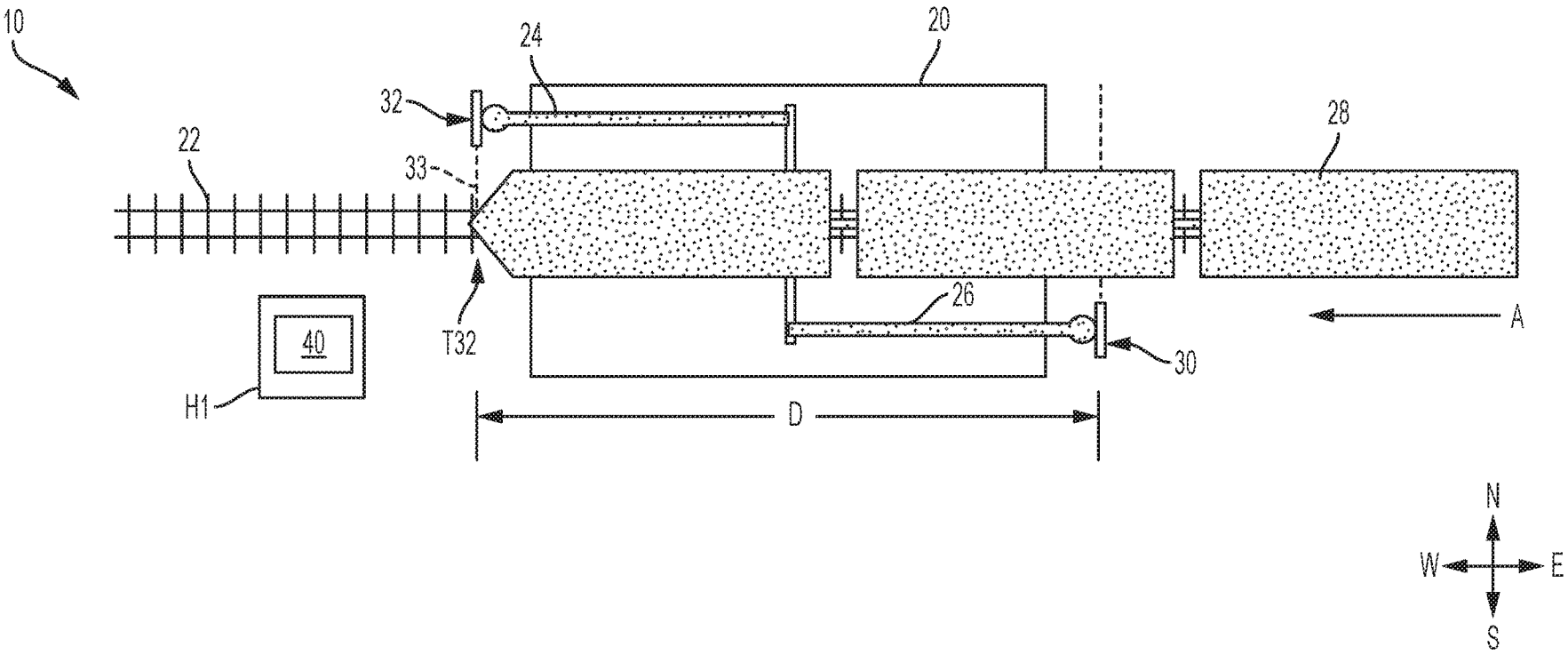

FIGS. 2A and 2B illustrate the system 10 of FIG. 1 in use. In the illustrated example, a train 28 is on the track 22 and approaching the crossing from the east side of the road 20. Moreover, in the illustrated example, the train 28 is heading west as shown by arrow A. In this example, and as shown in FIG. 2A, the laser beam 31 from the first laser device 30 is reflected back by the train 28 at time T30 when the train 28 reaches the beam 31. When this occurs, the first laser device 30 transmits a train detection signal to the control unit 40. As noted above, in one embodiment, the first laser device 30 can transmit the train detection signal and information identifying the first laser device 30 as the device that detected the train 28. The control unit 40 can time stamp and record the receipt of the signal at time T30 and associate it with the first laser device 30. In one alternative embodiment, the first laser device 30 can send the time T30 to the control unit 40 in addition to or instead of the control unit 40 recording the time stamp.

In the illustrated example, and as shown in FIG. 2B, the laser beam 33 from the second laser device 32 is reflected back by the train 28 at time T32 when the train 28 reaches the beam 33. When this occurs, the second laser device 30 transmits a train detection signal to the control unit 40. As noted above, in one embodiment, the second laser device 32 can transmit the train detection signal and information identifying the second laser device 32 as the device that detected the train 28. The control unit 40 can time stamp and record the receipt of the signal at time T32 and associate it with the second laser device 32. In one alternative embodiment, the second laser device 32 can send the time T32 to the control unit 40 in addition to or instead of the control unit 40 recording the time stamp.

Figure 3:
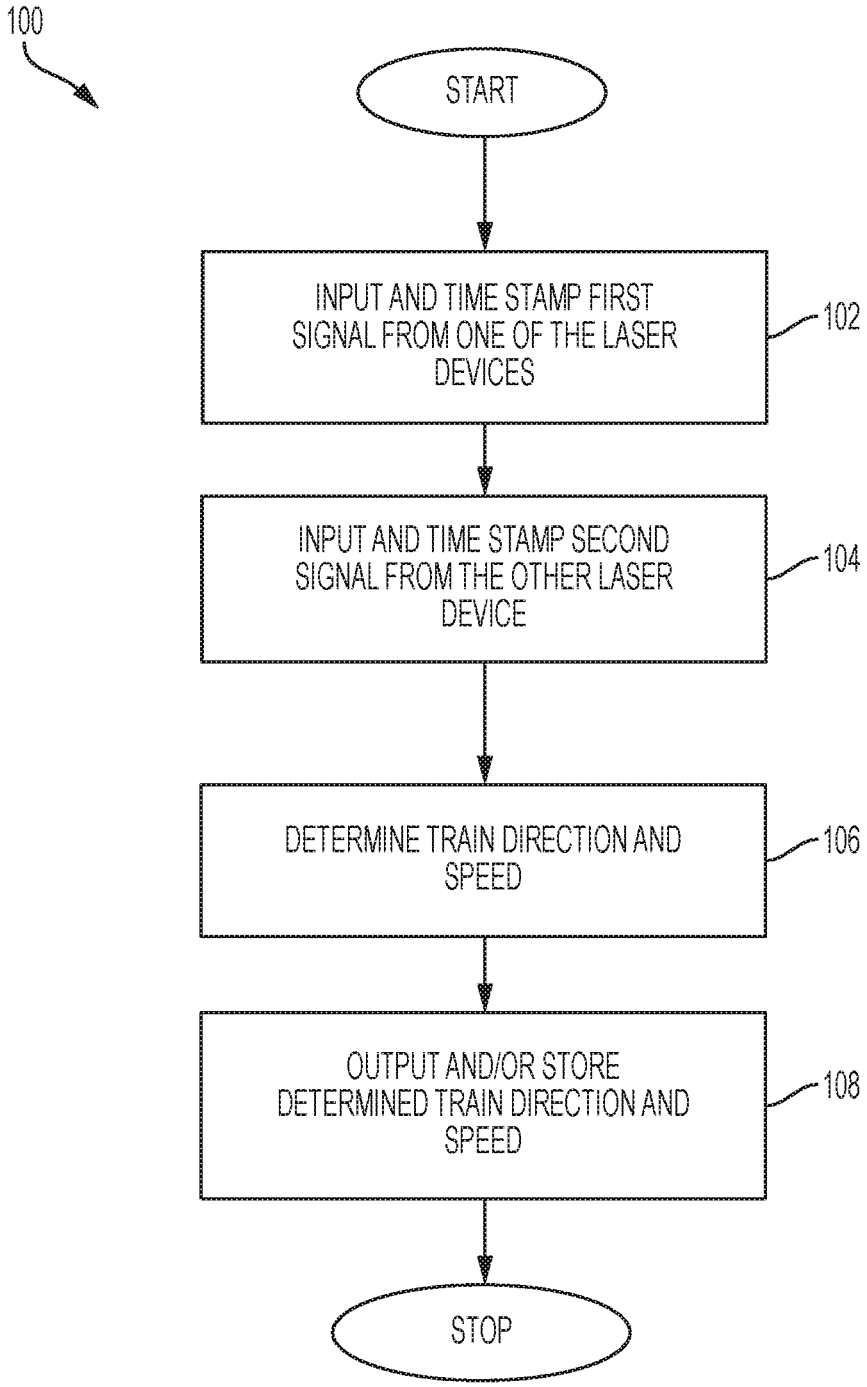
FIG. 3 illustrates an example process for determining train direction and speed and using the determination to monitor, diagnose and/or report the status of a crossing warning system performed in accordance with an embodiment disclosed herein.

FIG. 3 illustrates an example process 100 for determining train direction and speed and using the determination to monitor, diagnose and/or report the status of a crossing warning system performed in accordance with an embodiment disclosed herein. The process 100 is performed by the control unit 40 in an automated manner. The process 100 can be run periodically or at different time intervals as desired by the railroad company and/or maintenance personnel. In the following description, it is presumed that a train 28 is approaching from the east and heading west on the track 22 as shown in FIGS. 2A and 2B. Accordingly, by way of example only, the first laser device 30 will detect the presence of the train 28 first at time T30 (FIG. 2A) and the second laser device 32 will subsequently detect the presence of the train 28 at time T32 (FIG. 2B).

The method 100 begins at step 102 when a first train detection signal is received from one of the laser devices 30, 32 and input by the control unit 40. In one embodiment, the train detection signal and information identifying the laser device that detected the train (e.g., first laser device 30) is transmitted to the control unit 40. The control unit 40 creates a time stamp (e.g., T30) for the received signal and associates it with the identified laser device (e.g., first laser device 30). It should be appreciated that the train detection signal and the laser device identifying information can be part of the same message or different messages transmitted from the laser device to the control unit 40. Only one time stamp, however, is required even if the information is received via different messages.

At step 104, a second train detection signal is received from the other laser device (e.g., second laser device 32) and input by the control unit 40. As discussed above, in one embodiment, the train detection signal and information identifying the laser device that detected the train (e.g., second laser device 32) is transmitted to the control unit 40. The control unit 40 creates a time stamp (e.g., T32) for the received signal and associates it with the identified laser device (e.g., second laser device 32). It should be appreciated that the train detection signal and the laser device identifying information can be part of the same message or different messages transmitted from the laser device to the control unit 40. Only one time stamp, however, is required even if the information is received via different messages.

At step 106, the control unit 40 determines the train direction and speed based on the input information, the time stamps and the distance D between the laser devices 30, 32. For example, in one embodiment, the control unit 40 uses the following equation to determine the train direction and speed:

$$V=D/(T30-T32) \quad (1)$$

Where V is the speed (i.e., velocity) of the train, D is the predetermined distance D between the laser devices 30, 32 (as discussed above), T30 is the time stamp associated with the signal received from the first laser device 30 and T32 is the time stamp associated with the signal received from the second laser device 32. It should be appreciated that the distance D and velocity V can be in any units suitable for monitoring trains and crossing warning systems. For example, the unit for the distance D can be e.g., feet, yards or meters while the units for the velocity V can be miles/hour, meters/sec, etc. Likewise, the time stamps T30, T32 can by in any temporal units suitable for monitoring trains and the operational crossing warning systems (e.g., seconds, milliseconds, time of day, etc.).

Because in the illustrated example, the above equation always subtracts the time stamp T32 of the second laser device 32 from the time stamp T30 of the first laser device 30, the direction of the train 28 can be determined based on whether V is a positive or negative value. For example, if V is a positive value, then the train 28 is heading eastbound because T32 will be less than T30 (i.e., T32 is earlier in time than T30 and T30-T32 results in a positive number). If V is a negative number, then the train 28 is heading westbound (as shown in FIGS. 2A and 2B) because T32 will be larger than T30 (i.e., T32 is later in time than T30 and T30-T32 results in a negative number). If V is negative, the absolute value of V will be stored and used as the speed of the train.

In another embodiment, the control unit 40 can determine the direction of the train by simply determining which laser device 30, 32 detected the train first. For example, the control unit 40 can compare T30 to T32 and if T30 is greater than T32, the second laser device 32 detected the train first and therefore, the train is headed eastbound. If T30 is less than T32, the first laser device 30 detected the train first and therefore, the train is headed westbound. The velocity of the train can be determined using equation (1). If V is negative, the speed of the train will be the absolute value of V.

At step 108, the control unit 40 can output and/or store the determined direction and speed from step 106. For example, the determined direction and speed from step 106 can be printed, displayed, stored on a recording medium, or transmitted to another computer where the information can be reviewed, correlated with and/or compared to warning times determined by the crossing warning system (e.g., grade crossing predictor) installed at the crossing to determine if the warning time device is activating the crossing warning devices 24, 26 at proper times. As can be appreciated, the output information from step 108 can be used to monitor and/or diagnose problems or potential problems with the crossing warning system.

Figure 4:
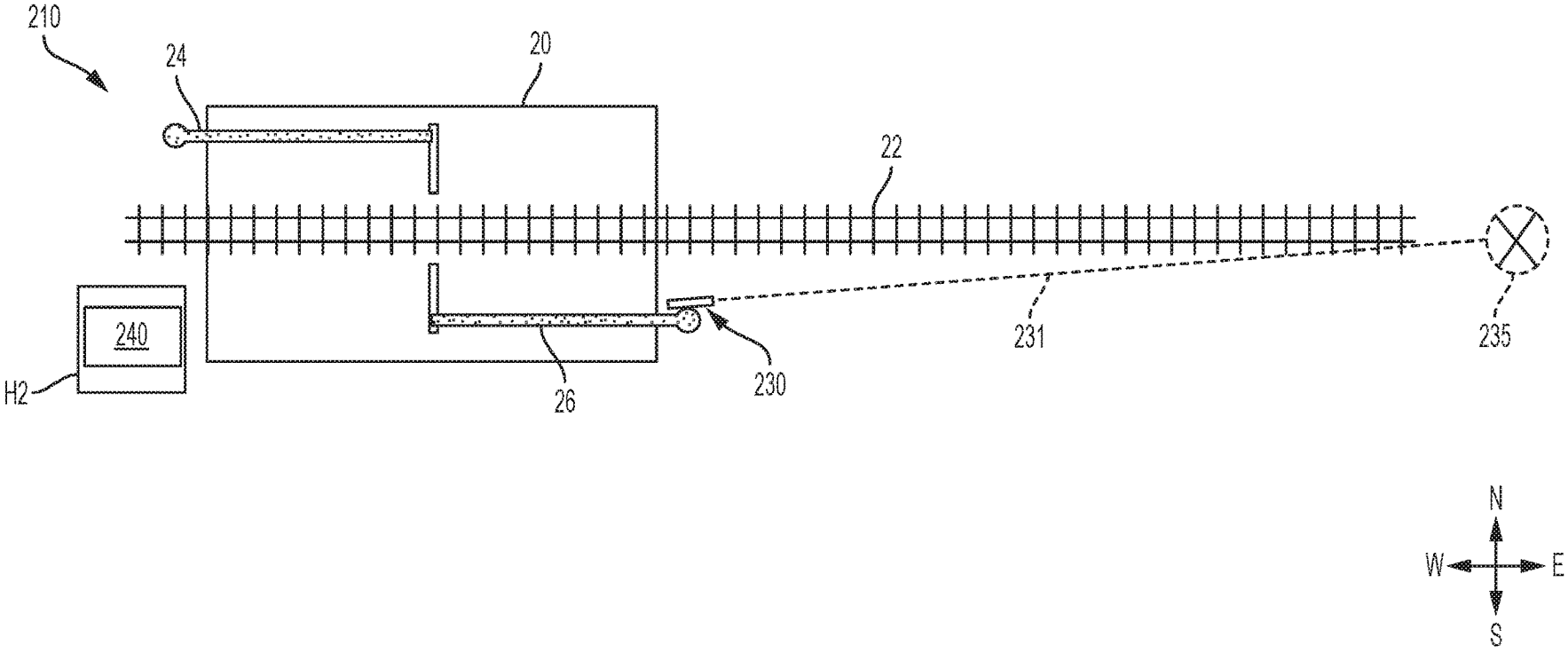
FIG. 4 illustrates an overhead and block view of another example system for determining train direction and speed and using the determination to monitor, diagnose and/or report the status of a crossing warning system constructed in accordance with an embodiment disclosed herein.

FIG. 4 illustrates an overhead and block view of another example system 210 for determining train direction and speed and using the determination to monitor, diagnose and/or report the status of a crossing warning system constructed in accordance with another embodiment disclosed herein. In the illustrated embodiment, the system 210 is provided at a location in which a road 20 crosses a railroad track 22 (i.e., a railroad crossing). The illustrated track 22 is laid out in an east-to-west/west-to-east direction. Thus, in the illustrated embodiment, there are two directions for a train to pass through the crossing (i.e., heading east-to-west or heading west-to-east). It should be appreciated, however, that the track 22 could be laid out in other directions as is known in the art.

Two warning devices implemented as first and second railroad crossing gates 24, 26 are also located at the crossing of the road 20 and railroad track 22. In the illustrated example, the arms of the crossing gates 24, 26 are lowered (e.g., in a horizontal position) blocking both sides of the road 20 from oncoming vehicular traffic as is known in the art. Although not shown in FIG. 4, the first and second railroad crossing gates 24, 26 are controlled by a crossing warning system that is connected to the track such as e.g., a grade crossing predictor as is known in the art. The grade crossing predictor (not shown) may be included in an equipment housing H2 such as e.g., a wayside shelter.

To implement the laser-based train direction and speed monitoring and determinations disclosed herein, the illustrated system 210 includes a laser measurement device 230 located on a first side of the crossing of the road 20 and railroad track 22. The laser measurement device 230 outputs a laser beam 231 towards a target area 235 along or next to the track 22. The laser measurement device 230 determines a measured distance to the target area 235 based on the unbroken path of the laser beam 231. Measurements can be taken periodically or aperiodically at any rate desired by the railroad corporation and/or maintenance personnel. In one embodiment, the measurement is taken periodically, once per second. In one embodiment, the rate can be within a range from once per 100 milliseconds to once per 5 seconds. It should be appreciated that the disclosed embodiments should not be limited to a particular rate.

The laser measurement device 230 is in communication with a control unit 240, which may be a processor, microprocessor, computer, computer workstation, laptop computer or a similar device that may also be included in the housing H2. The laser measurement device 230 may be in wired or wireless communication with the control unit 240. It should be appreciated that any form of wired communications and connections can be used such as e.g., wired serial port connections, parallel port connections, Ethernet connections, wired Internet Protocol or network connections, etc. Moreover, it should be appreciated that any form of wireless communications can be used such as e.g., Wi-FI, cellular, Bluetooth, Near-field Communications, Zigbee, Satellite, etc.

In one embodiment, the laser measurement device 230 will generate and output a distance measurement determined by the laser beam 231 at a predetermined rate (such as the rate discussed above). When no train is approaching, the received measurement will be large or infinite since the beam 231 is not reflected back. This measurement can be ignored.

The control unit 240 is capable of inputting measurements output from the laser measurement device 230 and will be able to determine train direction and speed (explained below in more detail with respect to FIG. 6) based on changes in the measurements it receives from the laser device 230 and the timing of the measurements.

Figure 5A:
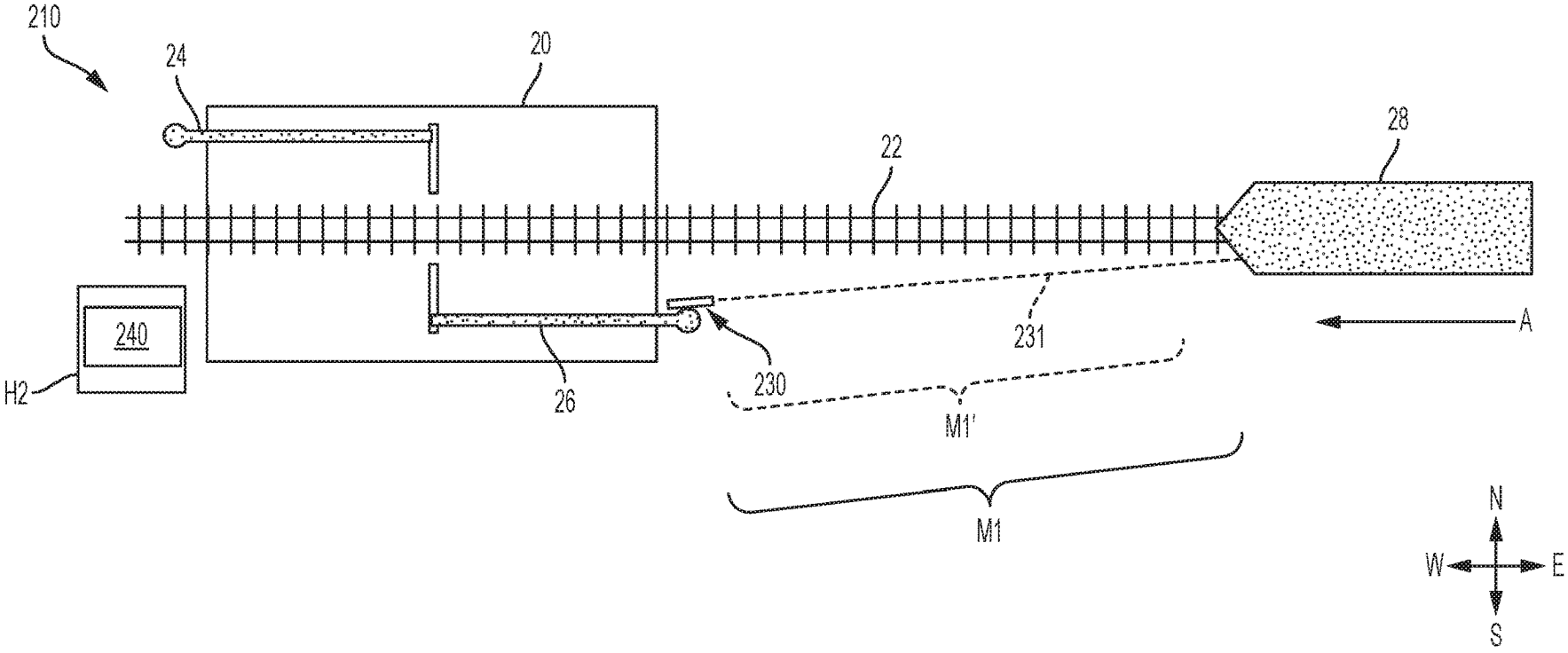
FIGS. 5A and 5B illustrate the system of FIG. 4 in use.
Figure 5B:
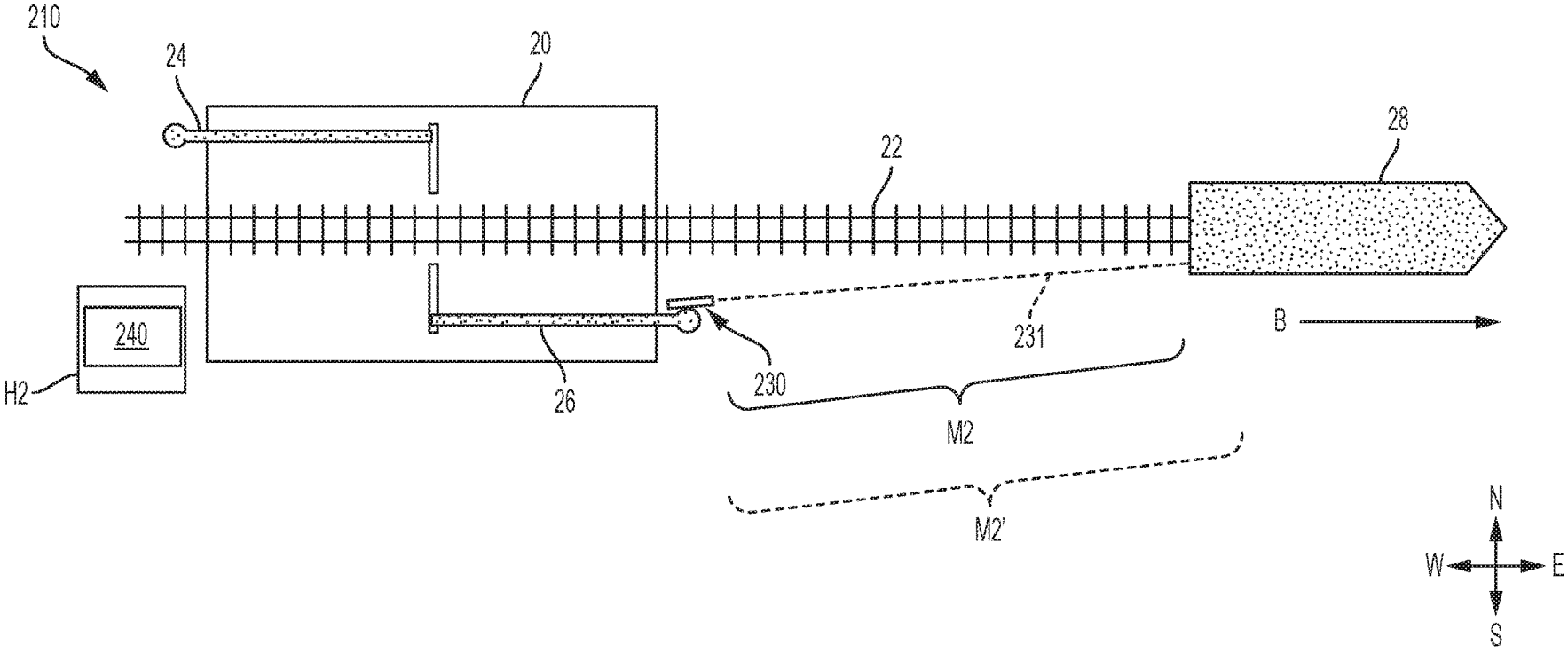

FIGS. 5A and 5B illustrate the system 210 of FIG. 4 in use. In the illustrated example of FIG. 5A, a train 28 is on the track 22 and approaching the crossing from the east side of the road 20. Moreover, in the illustrated example, the train 28 is heading west as shown by arrow A. In this example, the laser beam 231 from the laser measurement device 230 is reflected back by the train 28 leading to measurement M1 at that time (i.e., the distance to the front of the train 28 is M1 at the time of the measurement). Over time, and as the train 28 continues on its path, more measurements M1' (shown by the dashed bracket) are taken. As can be appreciated, the distance of the measurements M1' decreases over time (i.e., the distance to the front of the train 28 is getting closer to the crossing). These measurements M1, M1' are transmitted to the control unit 240. As discussed below, the control unit 240 can determine that the train 28 is heading west because the distances in the measurements M1, M1' are decreasing over time. Moreover, the control unit 240 can determine the train's 28 speed by the rate of change in the measurements M1, M1' (i.e., how quickly the measurements are decreasing).

In the illustrated example of FIG. 5B, a train 28 is on the track 22 and leaving the crossing heading in the east direction as shown by arrow B. Although not shown in FIG. 5B, the train approached the crossing from the west side of the road 20. In this example, the laser beam 231 from the laser measurement device 230 is reflected back by the train 28 leading to measurement M2 (i.e., the distance to the back of the train 28 is M2). Over time, and as the train 28 continues on its path, more measurements M2' (shown by the dashed bracket) are taken. As can be appreciated, the distance of the measurements M2' increases over time (i.e., the distance to the back of the train 28 is getting further away from the crossing). These measurements M2, M2' are transmitted to the control unit 240. As discussed below, the control unit 240 can determine that the train 28 is heading east because the distance in the measurements M2, M2' are increasing over time. Moreover, the control unit 240 can determine the train's 28 speed by the rate of change in the measurements M2, M2' (i.e., how quickly the measurements are decreasing).

Figure 6:
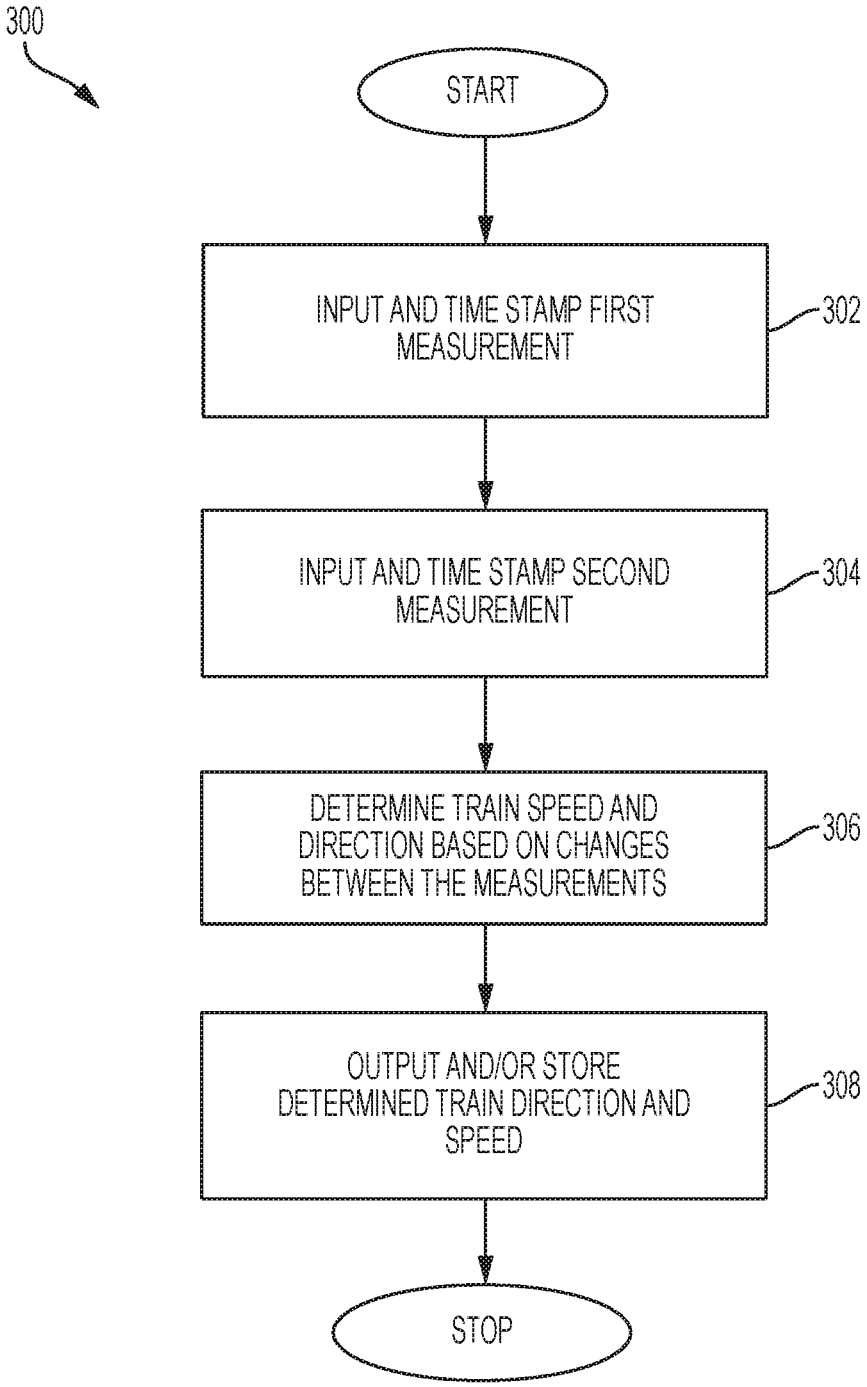
FIG. 6 illustrates another example process for determining train direction and speed and using the determination to monitor, diagnose and/or report the status of a crossing warning system performed in accordance with an embodiment disclosed herein.

FIG. 6 illustrates an example process 300 for determining train direction and speed and using the determination to monitor, diagnose and/or report the status of a crossing warning system performed in accordance with an embodiment disclosed herein. The process 300 is performed by the control unit 240 in an automated manner. The process 300 can be run periodically or at different time intervals as desired by the railroad company and/or maintenance personnel.

The method 300 begins at step 302 when a first measurement is received from the laser measurement device 230 and input by the control unit 40. The first measurement will be referred to herein as first measurement M302. The first measurement M302 could be e.g., measurement M1 (FIG. 5A) if the detected train is approaching from the east and heading west. The first measurement M302 could be e.g., measurement M2 (FIG. 5B) if the detected train is approaching from the west and heading east. In addition, at step 302, the control unit 240 creates a time stamp for the received first measurement M302. This time stamp will be referred to herein as time stamp T302.

At step 304, a second measurement is received from the laser measurement device 230 and input by the control unit 40. The second measurement will be referred to herein as second measurement M304. The second measurement M304 could be e.g., measurement M1' (FIG. 5A) if the detected train is approaching from the east and heading west. In this case the measured distance would be decreasing. The second measurement M304 could be e.g., measurement M2' (FIG. 5B) if the detected train is approaching from the west and heading east. In this case the measured distance would be increasing. In addition, at step 304, the control unit 240 creates a time stamp for the received second measurement M304. This time stamp will be referred to herein as time stamp T304.

At step 306, the control unit 240 uses the changes between the first and second distance measurements M302, M304 and the respective time stamps T302, T304 to determine the train speed and direction. For example, train direction can be determined by the following equation:

$$\Delta M = M302 - M304 \quad (2)$$

Where ΔM is the change in distance between the first and second measurements. If the result of the subtraction is positive, then the first input measurement M302 is greater than the second input measurement M304, meaning that the measured distance is decreasing over time (i.e., M304<M302)—therefore, the train is heading west (as shown in FIG. 5A). If the result of the subtraction is negative, then the first input measurement M302 is less than the second input measurement M304, meaning that the measured distance is increasing over time (i.e., M304>M302)—therefore, the train is heading east (as shown in FIG. 5B).

The train speed can be calculated by determining the rate of change between the first and second distance measurements. That is, train speed can be determined by the following equation:

$$V = \Delta M / (T302 - T304) \quad (3)$$

Where V is the speed (i.e., velocity) of the train and ΔM is the change in distance between the first and second measurements M302, M304 (i.e., M302-M304). It should be appreciated that because the above equation always subtracts the second input measurement M304 from the first input measurement M302, the direction of the train 28 can be determined based on whether V is positive or negative. For example, if V is a positive number, then the train 28 is heading eastbound because M302 (as shown in FIG. 5B) will be greater than M304. If V is a negative number, then the train 28 is heading westbound (as shown in FIG. 5A) because M302 will be less than M304. As discussed above, if V is negative, the absolute value of V will be used and stored as the speed of the train.

It should be appreciated that the distance measurements M302, M304 and velocity V can be in any units suitable for monitoring trains and crossing warning systems. For example, the unit for the distance measurements M302, M304 can be e.g., feet, yards or meters while the units for the velocity V can be miles/hour, meters/sec, etc. Likewise, the time stamps T302, T304 can by in any temporal units suitable for monitoring trains and crossing warning systems (e.g., seconds, milliseconds, time of day, etc.).

In an alternative embodiment, where measurements are made at a known rate R (e.g., 1/Sec), the time stamps T302, T304 would not be required. Since the timing of the measurements M302, M304 is already known (i.e., rate R), then the speed V of the train in the alternative embodiment can be determined by:

$$V=\Delta M*R \tag{4}$$

At step 308, the control unit 240 can output and/or store the determined direction and speed from step 306. For example, the determined direction and speed from step 306 can be printed, displayed, stored on a recording medium, or transmitted to another computer where the information can be reviewed, correlated with and/or compared to warning times determined by the crossing warning system (e.g., grade crossing predictor) installed at the crossing to determine if the warning time device is activating the crossing warning devices 24, 26 at proper times. As can be appreciated, the output information from step 308 can be used to monitor and/or diagnose problems or potential problems with the crossing warning system.

It should be appreciated that the control unit 240 can receive and input multiple measurements (e.g., at a periodic or other rate) and could repeat steps 302 to 306 to achieve a larger sample size before performing step 308. Alternatively, the control unit 240 can receive and input multiple measurements (e.g., at a periodic or other rate) and repeat steps 302 to 308 for every pair or set of measurements received from the laser measurement device 230.

Since they are automated, the disclosed methods 100, 300 could be performed as often as the railroad company or maintenance personnel desire. Moreover, the disclosed embodiments could be used to replace the traditional mandated and manual annual inspections of grade crossing predictors, if desired. For example, an automated test of a grade crossing predictor could be performed as follows. The control unit 40, 240 will include the designed warning time for the location, which is a fixed value that does not change over time. It can be entered by a user or received from another system (e.g. by messages from an office). This is the minimum warning time that is acceptable for the location. The control unit 40, 240 will also include the maximum permissible speed for each train direction, which is fixed and does not change over time. It can be entered by the user or received from another system (e.g. by a message). The control unit 40, 240 can determine the measured warning time by any method known in the art. If the measured warning time is greater than or equal to the designed warning time and the train speed was at or near (allowing for some margin) the maximum permissible speed, the control unit 40, 240 can consider this a "good train move". Based on the direction, the control unit 40, 240 can determine if there has been a "good train move" for both directions through the crossing and if so, can consider the warning time tests for this crossing complete for the designated period of time (e.g., 1 year). If the control unit 40, 240 determines that this was not a "good train move", the information can be stored for diagnostic and other purposes.

In addition, it should be appreciated that while the disclosed embodiments have been described for use in monitoring and diagnostic testing of crossing warning systems, they could be used for other purposes. For example, the disclosed system and methods could be used for traffic tracking (e.g., monitoring and reporting the time, train speed and direction of trains passing through the crossing).

The disclosed embodiments can be implemented in a simple and low cost manner because the systems 10, 210 and methods 100, 300 are not being used to control the crossing warning devices (i.e., they are not part of the grade crossing predictors)—therefore, they are not safety critical as they are an overlay used for diagnostic, monitoring and testing purposes only. Moreover, the disclosed systems 10, 210 can be implemented at any railroad crossing or other installation as they are not tied to any particular grade crossing predictor or railroad equipment. Another advantage of the disclosed embodiments is that they can achieve consistent results because they are automated and do not rely on manual operations or human intervention.

The foregoing examples are provided merely for the purpose of explanation and are in no way to be construed as limiting. Further areas of applicability of the present disclosure will become apparent from the detailed description, drawings and claims provided hereinafter. While reference to various embodiments is made, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

Additionally, the purpose of the Abstract is to enable the patent office and the public generally, and especially the scientists, engineers and practitioners in the art who are not familiar with patent or legal terms or phraseology, to determine quickly from a cursory inspection the nature of the technical disclosure of the application. The Abstract is not intended to be limiting as to the scope of the present inventions in any way.

I claim:

1. A system comprising:

at least one laser device adapted to provide a laser beam towards a location on a railroad track and being adapted to provide one or more outputs when the laser beam is reflected back by a train traversing the track, the one or more outputs including a train detection signal and information identifying the at least one laser device; and a control unit adapted to input the one or more outputs from the at least one laser device, time stamp and record receipt of the train detection signal and associate the train detection signal with the at least one laser device based on the information identifying the at least one laser device, and determine a direction and speed of the train based on the one or more outputs from the at least one laser device and timing information associated with the one or more outputs, wherein the control unit is further adapted to output and store determined direction and speed of the train for review or comparison to warning times determined by a cross warning system to determine whether the crossing warning system activates crossing warning devices at proper times.

2. The system of claim 1, wherein the at least one laser device comprises:

a first laser device adapted to provide a first laser beam towards a first location on the track and being adapted to provide a first output when the first laser beam is reflected back by the train traversing the track; and a second laser device adapted to provide a second laser beam towards a second location on the track and being adapted to provide a second output when the second laser beam is reflected back by the train traversing the track.

3. The system of claim 2, wherein the control unit is adapted to determine the direction of the train based on a difference between timing information associated with the first and second outputs.

4. The system of claim 3, wherein a positive value of the difference is associated with a first direction of the train and a negative value of the difference is associated with a second direction of the train.

5. The system of claim 2, wherein said first and second laser devices are a predetermined distance apart and the control unit is adapted to determine the speed of the train based on a difference of timing information associated with the first and second outputs and the predetermined distance.

6. The system of claim 2, wherein the control unit is adapted to generate a first time stamp for the first output and a second time stamp for the second output and to determine the direction of the train based on a difference between the first and second time stamps.

7. The system of claim 6, wherein a positive value of the difference between the first and second time stamps is associated with a first direction of the train and a negative value of the difference between the first and second time stamps is associated with a second direction of the train.

8. The system of claim 1, wherein the one or more outputs from the at least one laser device comprises distance measurements generated and output over time as the train traverses the track.

9. The system of claim 8, wherein the control unit is adapted to determine the direction of the train based on whether the distance measurements increase or decrease over time.

10. The system of claim 9, wherein increasing distance measurements are associated with a first direction of the train and decreasing distance measurements are associated with a second direction of the train.

11. The system of claim 8, wherein the control unit is adapted to determine the speed of the train based on a rate of change of the distance measurements.

12. A method comprising:

inputting one or more outputs from at least one laser device while a train is traversing a railroad track, the one or more outputs including a train detection signal and information identifying the at least one laser device;

time stamping and recording receipt of the train detection signal and associating the train detection signal with the at least one laser device based on the information identifying the at least one laser device;

determining a direction and speed of the train based on the one or more outputs from the at least one laser device and timing information associated with the one or more outputs, and outputting and storing determined direction and speed of the train for review or comparison to warning times determined by a crossing warning system to determine whether the crossing warning system activates crossing warning devices at proper times.

13. The method of claim 12, wherein the at least one laser device comprises a first laser device adapted to provide a first laser beam towards a first location on the track and being adapted to provide a first output when the first laser beam is reflected back by the train traversing the track and a second laser device adapted to provide a second laser beam towards a second location on the track and being adapted to provide a second output when the second laser beam is reflected back by the train traversing the track, and said inputting step comprises inputting the first and second outputs from the first and second laser devices.

14. The method of claim 13, wherein determining the direction of the train comprises determining a difference between timing information associated with the first and second outputs.

15. The method of claim 14, wherein a positive value of the difference is associated with a first direction of the train and a negative value of the difference is associated with a second direction of the train.

16. The method of claim 13, wherein said first and second laser devices are a predetermined distance apart and determining the speed of the train comprises determining a difference of timing information associated with the first and second outputs and the predetermined distance.

17. The method of claim 13, further comprising:

generating a first time stamp for the first output; and generating a second time stamp for the second output, wherein the direction of the train is determined based on a difference between the first and second time stamps.

18. The method of claim 17, wherein a positive value of the difference between the first and second time stamps is associated with a first direction of the train and a negative value of the difference between the first and second time stamps is associated with a second direction of the train.

19. The method of claim 12, wherein the one or more outputs from the at least one laser device comprises distance measurements generated and output over time as the train traverses the track.

20. The method of claim 19, wherein determining the direction of the train is based on whether the distance measurements increase or decrease over time.

21. The method of claim 20, wherein increasing distance measurements are associated with a first direction of the train and decreasing distance measurements are associated with a second direction of the train.

22. The method of claim 19, wherein determining the speed of the train is based on a rate of change of the distance measurements.

* * * * *